US011104548B2

(12) United States Patent
Teglia

(10) Patent No.: US 11,104,548 B2
(45) Date of Patent: Aug. 31, 2021

(54) MOBILITY AID DEVICE FOR OVERCOMING A LEVEL DIFFERENCE

(71) Applicant: Giovanni Teglia, Piombino (IT)

(72) Inventor: Giovanni Teglia, Piombino (IT)

( * ) Notice: Subject to any disclaimer, the term of this patent is extended or adjusted under 35 U.S.C. 154(b) by 423 days.

(21) Appl. No.: 16/314,787

(22) PCT Filed: Jul. 7, 2017

(86) PCT No.: PCT/IB2017/054101
§ 371 (c)(1),
(2) Date: Jan. 2, 2019

(87) PCT Pub. No.: WO2018/007989
PCT Pub. Date: Jan. 11, 2018

(65) Prior Publication Data

US 2019/0308847 A1 Oct. 10, 2019

(30) Foreign Application Priority Data

Jul. 8, 2016 (IT) ..... 102016000071622

(51) Int. Cl.
*B66B 9/08* (2006.01)

(52) U.S. Cl.
CPC ..... *B66B 9/0869* (2013.01)

(58) Field of Classification Search
CPC ..... B66B 9/0869; B66B 9/08; B66B 23/12
USPC ..... 187/200
See application file for complete search history.

(56) References Cited

U.S. PATENT DOCUMENTS

| | | | | |
|---|---|---|---|---|
| 4,457,402 | A * | 7/1984 | Del Vecchio | A61G 3/06 105/449 |
| 5,234,078 | A * | 8/1993 | Smith | B66B 9/0869 187/200 |
| 5,802,773 | A * | 9/1998 | Pingel | E04H 3/26 52/10 |
| 6,050,366 | A * | 4/2000 | Lyons | E04H 3/123 187/200 |
| 7,234,565 | B1 * | 6/2007 | Lam | B66B 9/0869 182/141 |
| 9,091,083 | B1 * | 7/2015 | Goudreau | E04F 11/0223 |
| 2013/0168189 | A1 * | 7/2013 | Ribas | B66B 9/0869 187/200 |

FOREIGN PATENT DOCUMENTS

| | | | |
|---|---|---|---|
| EP | 2913290 | A1 | 9/2015 |
| FR | 2877657 | A1 | 5/2006 |
| JP | 2005145709 | A | 6/2005 |
| NL | 2004022 | C | 9/2011 |

OTHER PUBLICATIONS

Vertitec: "Plataforma Vertical Bancolift", 2012, XP055366921, pp. 1-3.

International Search Report and Written Opinion for Corresponding International Application No. PCT/IB2017/054101 (14 Pages) ( dated Nov. 20, 2017).

* cited by examiner

*Primary Examiner* — Jeffrey Donels
(74) *Attorney, Agent, or Firm* — Lucas & Mercanti, LLP

(57) ABSTRACT

The present invention relates to an aid device for ascending and/or descending staircases for people with motor disabilities.

17 Claims, 7 Drawing Sheets

MOBILITY AID DEVICE FOR OVERCOMING A LEVEL DIFFERENCE

CROSS-REFERENCE TO RELATED APPLICATIONS

This application is a 371 of PCT/IB2017/054101, filed Jul. 7, 2017, which claims the benefit of Italian Patent Application No. 102016000071622, filed Jul. 8, 2016.

FIELD OF THE INVENTION

The present invention relates to an aid device for people with motor disabilities. Specifically and in a preferred embodiment thereof, the present invention relates to an aid device for overcoming a level difference as ascending/descending a flight of stairs.

BACKGROUND OF THE INVENTION

Currently, known aids for ascending or descending staircases for people with motor disabilities (such as older people, disabled people, overweight people, etc.) include goods lifts or lifts and stairclimbers.

With regards to goods lifts, they require significant structural work on the building and furthermore are costly to install with regards to scheduled and extraordinary maintenance. They cannot be installed in all buildings for these reasons. Moreover, in certain cases they are small—especially with regards to the access opening—and for this reason do not allow access by wheelchairs and/or pushchairs.

Known stairclimbers include the ones that slide on a guide anchored to the wall that runs alongside the steps, or the free ones with a motor on board and a wheel system capable of crossing the height of the step. With regards to fixed stairclimbers anchored to the wall, they also have significant installation and maintenance costs; moreover, the staircase should have given sizes in order to be installed. In particular, they are not suitable for narrow staircases or staircases with corners, that is with small landings. Lastly, such systems have a particularly significant effect in terms of appearance and therefore are not well accepted, especially in historical buildings of architectural value.

Free stairclimbers are more flexible in that certain types adapt also to very narrow staircases; however, they also have problems and in particular in order to be used, they require the aid of a non-disabled person who is capable of guiding the chair when the staircase is being ascended/descended.

Since the above-described systems are in any case quite impactful, they also affect the user psychologically, whose disability is emphasized.

Other aid systems for ascending/descending staircases are known for example, from Japanese Patent Application JP2005145709 or American U.S. Pat. No. 9,091,083. In both such states of the art, aids are described that imply significant masonry and structural work because they result in replacing existing staircases or preparing specific containment excavations or foundations in general.

Another example of aid devices is the one described in European publication EP2913290. Also in this case however, such system has problems. Firstly, although it may be associated with an existing staircase, in fact it replaces the step, thus being significantly voluminous during assembly and use. Therefore, the staircase is in any case constantly occupied by the device, which therefore results in a significant visual impact in terms of appearance.

SUMMARY OF THE INVENTION

It is therefore the object of the present invention to resolve the above problems.

In particular, it is a first object of the present invention to provide an aid system for ascending/descending staircases for people with motor disabilities that may be installed also on existing staircases without requiring significant architectural or structural work.

It is also a further object of the invention to provide an aid with reduced impact in terms of appearance, it being such as not to obstruct the step when it is not in use.

Finally, it is a further object to provide a group of versatile lifting devices in order to overcome various mobility needs.

It is a further object of the invention to provide a lifting device that is functionally and structurally simple and that lends itself to being combined with a complex aid system.

Such objects are achieved by the aid system according to the invention, the essential features of which are defined by the first of the appended claims. Further advantages are obtained from the successive claims. The same objects are also achieved by a process for ascending/descending staircases as set forth in claims 8, 9 and 10.

BRIEF DESCRIPTION OF THE DRAWINGS

The features and advantages of the aid system according to the invention shall be apparent from the description below of an embodiment thereof, made by way of a non-limiting example, with reference to the accompanying drawings in which:

FIG. 7 is an enlargement of the device shown in FIG. 6.

DETAILED DESCRIPTION OF THE INVENTION

Figure 1:
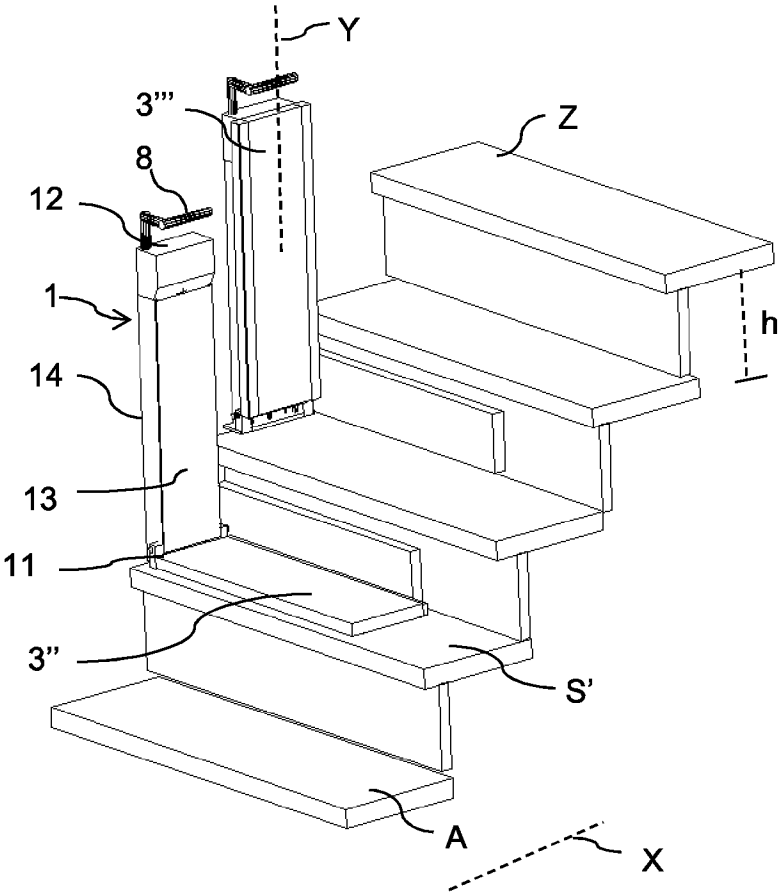
FIG. 1 shows an aid system according to the invention, installed on a staircase, comprising two lifting devices, of which a first device is in a working configuration while a second device is in a resting configuration.
Figure 2B:
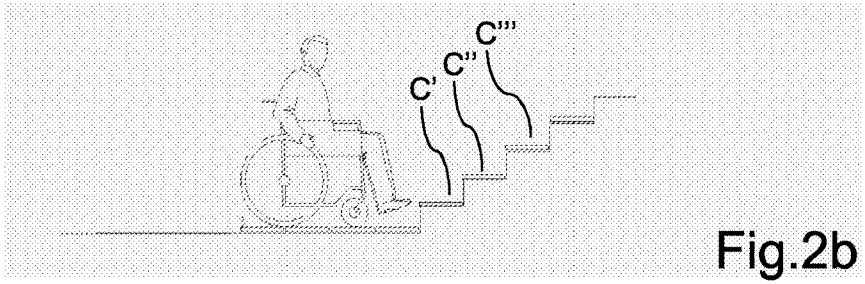
FIGS. 2*a* to 2*f* show the sequential operation of the aid according to the invention, in the action of a user with motor disabilities ascending a flight of stairs.
Figure 2A:
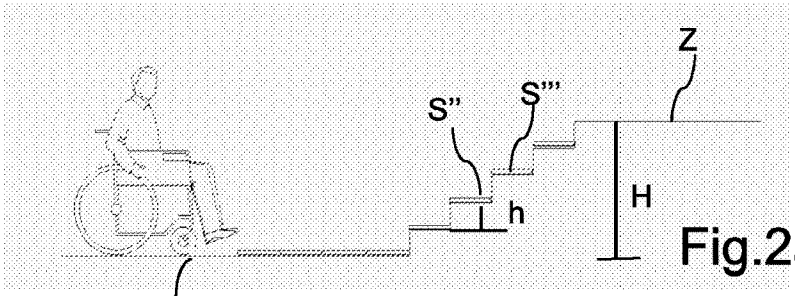
Figure 2D:
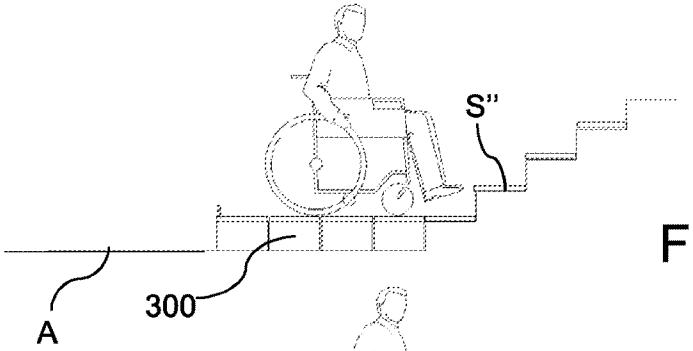
Figure 2C:
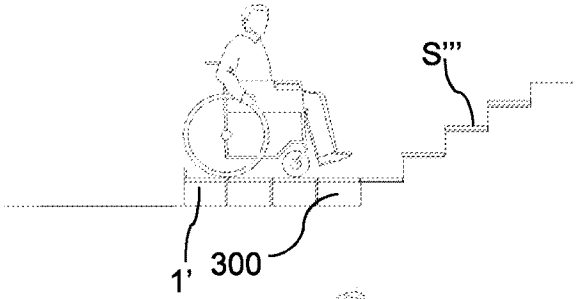
Figure 2F:
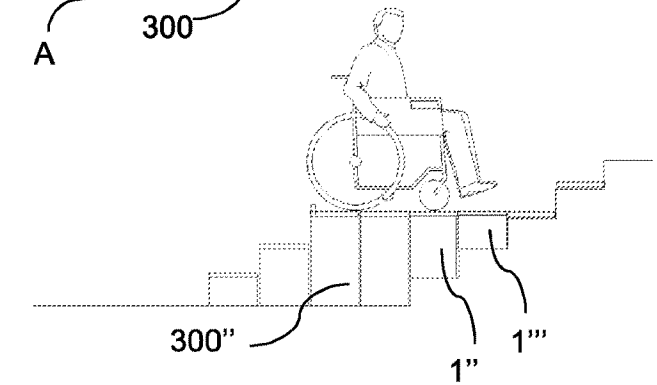
Figure 2E:
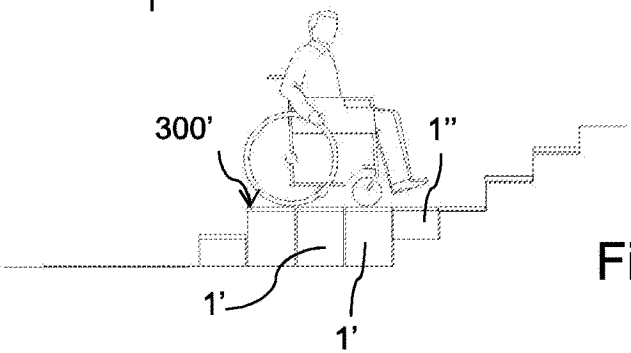

With reference to said drawings, a lifting device 1 comprises a frame 2 that has an extension according to its own main direction Y. The frame 2 is of the box-shaped type and is stably constrained, in place, to an attachment surface belonging to the drop so as to be in substantially vertical arrangement. The drop is commonly a flight of stairs that extends between a landing A and a floor Z that is raised with respect to the landing by a vertical drop H assessed on a vertical axis Y; the flight of stairs comprises a plurality of steps S', S", each defining a treading surface C', C" arranged horizontally and spaced vertically with respect to the preceding one by a drop h. Usually the step is delimited laterally, at least on one side, by a vertical wall (not depicted in the drawing) that runs along the whole ascent of the staircase. The frame 2 may therefore be attached to the landing or to the various treading floors on the individual steps or to the vertical wall that runs along the flight of stairs; alternatively, the frame 2 may also be attached to a handrail associated with the flight of stairs.

In a preferred solution, the box-shaped frame 2 has a substantially parallelepiped shape with two smaller faces, of which a lower face 11 and the other upper face 12, that are mutually opposite and parallel and are spaced along the direction Y, and two main faces, of which a front face 13 and the other rear face 14, that are mutually opposite and parallel and are spaced along the axis X.

If the device is attached to the treading surface, the attachment is performed on such lower face 11. Otherwise, if the frame is attached to the side wall at the drop, the attachment is performed on the rear face 14.

Possibly, the attachment of the frame may also occur on both the above-mentioned faces (i.e. the lower face 11 and rear face 12) to obtain a more stable attachment. Again, in a further variant, there may be provided support elements (not shown in the drawings) that extend in an L arrangement with the frame, from the front face 13. Such support elements, such as linear bars, are attached to the steps so as to stabilize the attachment of the frame to the drop.

In further detail, the lifting device comprises a lifting platform 3 attached pivotally to the frame at the lower face 10. In a resting condition, the platform 3 is such as to be leaning against the box-shaped frame in substantially vertical arrangement, and in particular against the front face 13. In a working position instead, the platform is arranged in substantially horizontal arrangement, according to the direction X, and in any case perpendicularly to the direction of extension of the frame Y; in such position, the platform (at least partially) overlaps the treading surface.

The lifting device further comprises driving means 4 such as to move the platform 3 vertically, i.e. along the direction Y up to crossing the drop. Such vertical movement is achieved when the platform is in working position.

Figure 5:
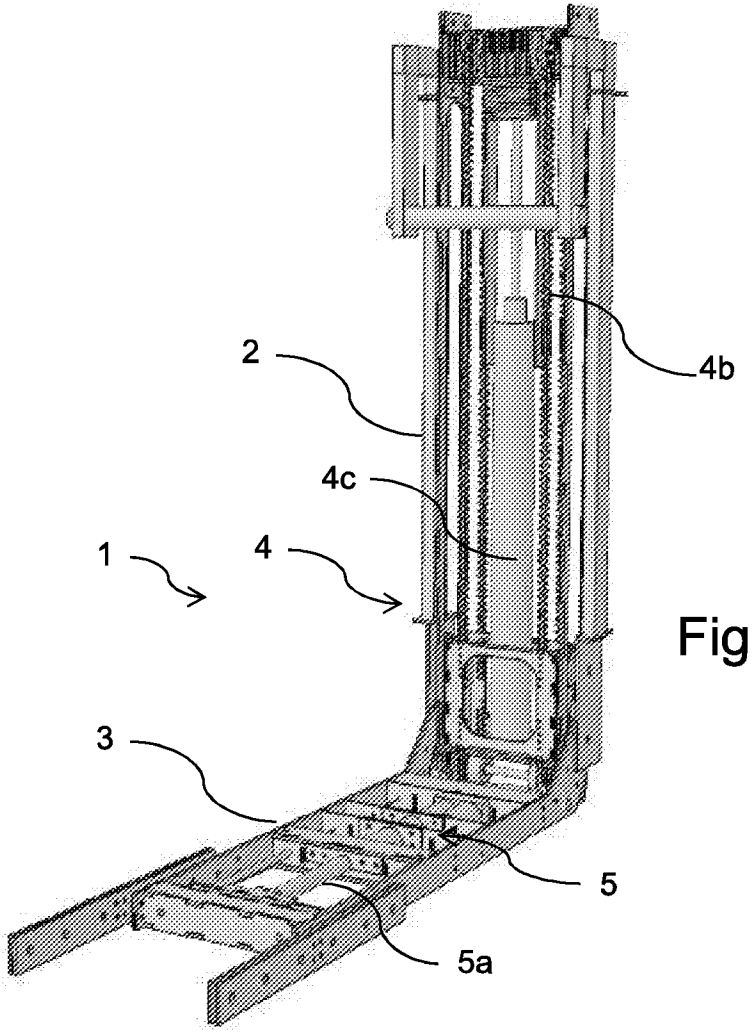
FIG. 5 depicts a first variant of the lifting device, and in particular of means for driving and overturning a platform of the device itself.
Figure 7:
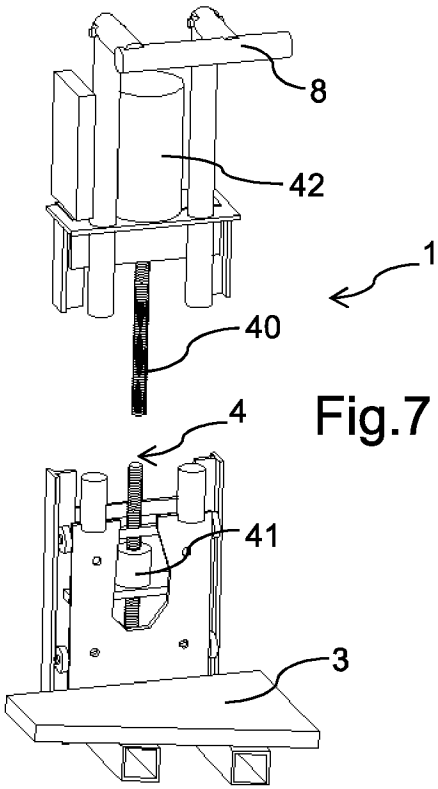
FIGS. 6 and 7 are respectively a view of a further variant of the lifting device, and in particular of driving and overturning means, where
Figure 6:
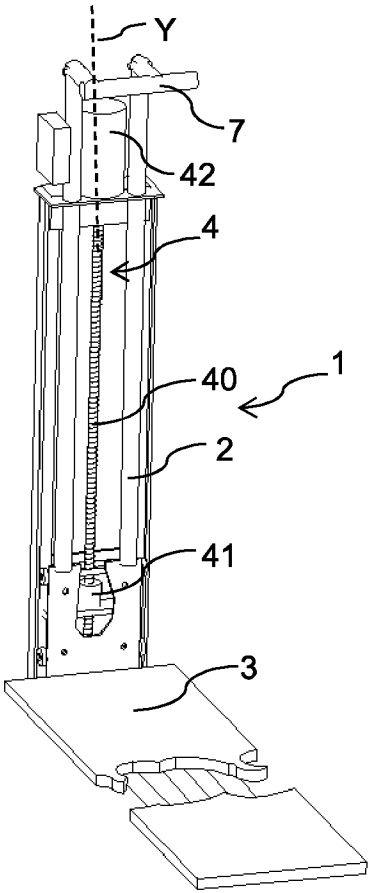

In a first embodiment shown in FIG. 5, the lifting platform 3 is constrained in a sliding manner to the frame by means of a carriage 4*a* driven along the direction Y by a chain gear 4*b*, moved by an electrical motor 4*c* which, in the solution shown in the drawings, is inserted in the frame itself.

In a second embodiment shown in FIGS. 6 to 8*c*, the driving means 4 provide an endless screw or screw nut 40 arranged according to the direction Y, which rotation movement is driven by an electrical motor 42. A leadscrew 41 attached to the platform meshes on the endless screw so that the rotation of the screw corresponds to the translation of the leadscrew and therefore of the platform thereon. In certain cases, it could be suitable to have two or more motors for the driving of the lifting system instead of a single electrical motor.

Again, there are provided overturning means 5 to bring the platform from the resting position to the working position.

In the solution shown in FIG. 5, the overturning means 5 comprise a linear actuator 5*a* which extends inside the platform coaxially to the main extension direction thereof. The stroke of the linear actuator 5 along said main extension direction acts on a leverage for connecting the end of the lifting platform to the carriage 4*a*, thus resulting in the rotation about the connection point indicated in the drawing as P1.

Figures 8A, 8B, 8C:
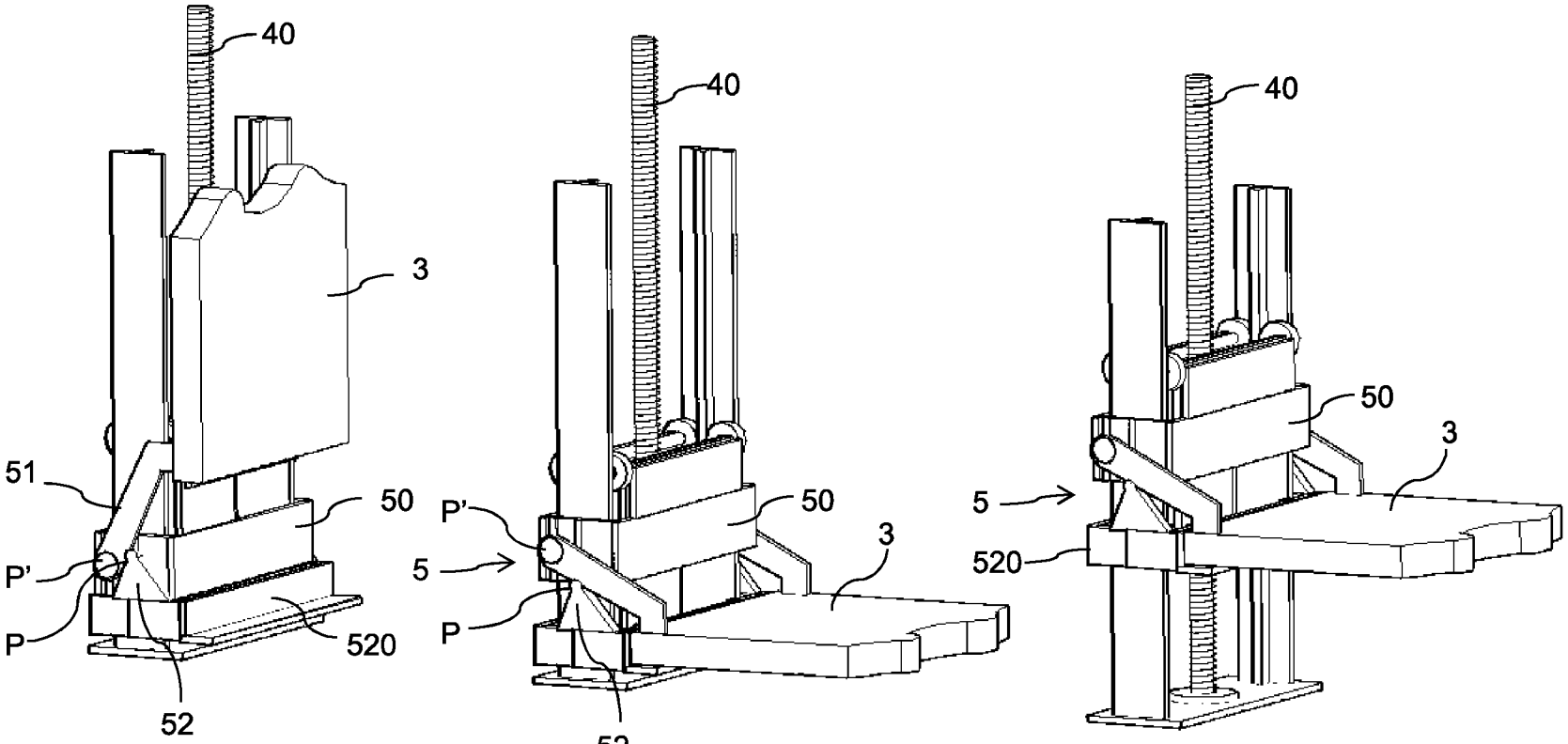
FIGS. 8*a* to 8*c* show the sequence of the moving procedure of the device in FIGS. 6 and 7, from the resting configuration to the working configuration.

In the second embodiment instead, the platform 3 is constrained to the carriage 5*a* by means of a lever 51 hinged in a decentralized position P' with respect to the symmetry axis of the carriage itself. The lever 51 is also constrained in a sliding manner to an attachment element 52 on an attachment point P. The attachment element 52 extends from a second carriage 520 which is in turn associated in a sliding manner with the frame but not with the endless screw, therefore it does not follow the upward translation movement thereof. Thus, given the sliding constraint between lever and attachment element, when the carriage moves upward, the platform tends to overturn with an improved roto-translation movement on such attachment point P, thus moving from the vertical resting position to the horizontal working position. The endless screw carries an abutment (not shown) that abuts with the attachment element once this first movement resulting in the overturning of the platform, is completed. Therefore, as a result of the abutment between the abutment and the attachment element, the further movement of the endless screw involves also the latter which follows the carriage in translation and drags the lifting platform in translation according to the direction Y, which platform therefore is lifted. Vice versa, to obtain the inverse movement, i.e. to bring the platform 3 from the working position to the resting position, the endless screw 40 rotates in opposite direction, thus bringing the platform next to the treading floor (FIG. 8*b*). At this point, when actuated, the further downward rotation of the endless screw makes the lever system act on the pin 51, thus overturning the lifting platform toward the vertical position. The movement is completed when the first carriage 50 abuts with the second carriage 520 (FIG. 8*a*).

The actuation of the electrical motor associated with the driving means may be manual by means of a button, or remote controlled, however this does not alter the fact that an automatic actuation may also be provided. In this case, a pressure sensor detects the presence of a user on the platform, thus triggering the lifting.

In a less costly embodiment, the overturning of the platform may be obtained manually be an operator.

The device is then equipped with electronic control means (not shown in the drawings), such as a programmable management board, for managing and controlling the above-mentioned driving means and overturning means.

If the step has a projection or edge, i.e. the second treading floor protrudes over the rise, in order to prevent the platform from hitting such projection during the ascending movement of it (or worse, to prevent the tip of the user's foot from being crushed between platform and projection), a further safety sensor may be provided, which detects the presence of obstacles positioned above the platform and actuates blocking the ascent thereof when needed.

In the case of whole flights of stairs or particularly high drops, the device may be associated with other similar combined-operation sensors. Such plurality of devices defines an aid system for ascending and/or descending a drop or a flight of stairs. It is worth noting for example, FIGS. 2*a* to 2*f*, in which there is shown the ascending sequence of a flight of stairs with the aid system according to the invention, by a person with motor disabilities bound to a wheelchair.

Such aid system comprises at least one lifting device 1' arranged on the landing A of the flight of stairs and one lifting device 1", 1'", 1"" for each step S; the aid system further comprises an elevator base 300 that can be translated along said vertical axis Y between the landing A and the raised floor Z, where the elevator base 300 is defined by one or more of the lifting platforms 3 actuated in combination in translation along the respective frames 1.

In the aid system according to the invention, each platform 3, 3', 3" has sizes that are at least equal to the ones of the treading surface of the individual step. However, it is useful to have an elevator base 300 with larger sizes on landing A so as to receive a user having a walking aid such as a wheelchair or a walker. On this subject, two or more lifting devices are positioned side-by-side on the landing A so that the sum of the platforms of the individual devices defines an elevator base 300 with adequate sizes, or there may be provided a single lifting device with a platform with larger sizes than the ones of the individual step.

There follows that the elevator base 300 at any one of said steps is defined at least by the platform of the lifting device belonging to the step itself and by the platform of the lifting device belonging to the step immediately preceding.

For the correct combined operation of the individual lifting devices, the lifting system according to the invention further comprises means for managing the lifting devices and accordingly the above-mentioned driving and overturning means.

The operation of the aid system is described in detail below.

After prior positioning in the working configuration of all the platforms of the plurality of devices forming the system, when the user involves the first elevator base 300, it is lifted to cross the rise of the first step (FIG. 2*c*), thus reaching the treading surface of the first step, in coplanar arrangement with the platform associated to such first step. The user then advances slightly on the combined elevator base consisting of the platform associated to the landing and the one associated to the first step. If only one platform belongs to the landing, then the resulting elevator base comprises also the landing platform in its ascent up to when the sum of the surface of the platforms of the successive steps is such as to contain the user. At this point, the landing platform interrupts its ascent.

The same procedure is repeated for the successive steps up to reaching the raised floor.

Advantageously therefore, once the elevator base reaches the raised floor, the platforms of the steps not involved by the elevator base itself and downstream of it are available to the flight of stairs. This configuration is particularly advantageous because in the event of a malfunction, it is in any case easy to reach the user by ascending the flight of stairs defined by the platforms.

Once the raised floor is reached, the platforms return to the resting position.

Alternatively, the platforms may be lowered as the user ascends toward the raised floor, starting from the ones belonging to the devices furthest downstream of the staircase.

To descend the staircases instead, firstly a congruous number of platforms belonging to steps immediately below the raised floor should be lifted up to the level of the latter in order to contain the user. The platforms belonging to the other steps are raised instead by the value h, i.e. by the value of one step until there is again a flight of stairs downstream of the elevator base. This implies the same advantage in terms of safety with respect to the above-described malfunctions.

Afterward, the elevator base thus obtained may be lowered down to the level of the lower platform; the user is then moved onto the elevator base obtained with the aid of said first free raised platform to free the platform associated with the step below; the elevator base is then lowered down to the step below. Such operations are repeated until the landing is reached. Also in this case, the platforms may return to the resting position at the end of the descent of the staircase, or alternatively in a sequential manner during the descent itself.

In addition to the ones described above, there may be further methods of configuring the electronic management of the system, also according to the requests of the user.

Figure 3:
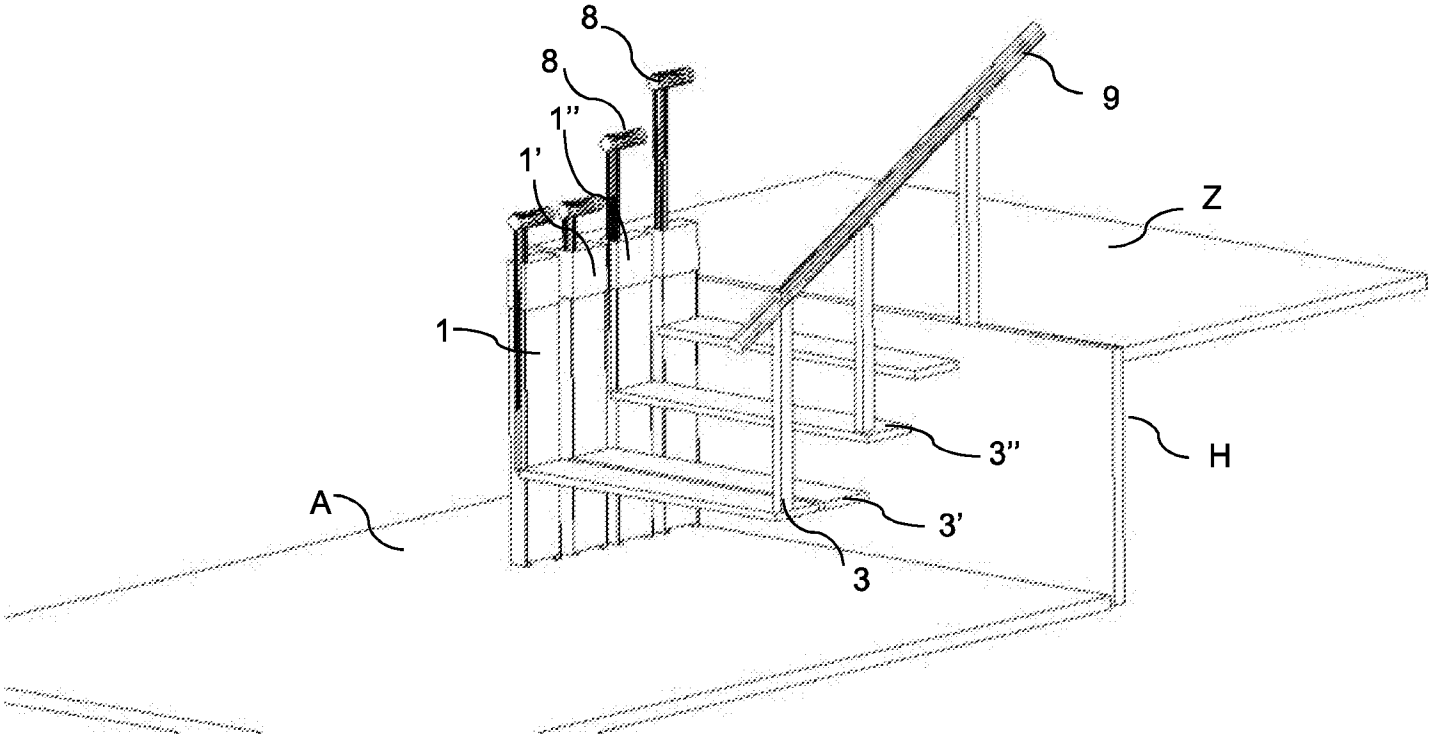
FIG. 3 shows a group of devices in functional arrangement in the form of a flight of stairs.
Figure 4:
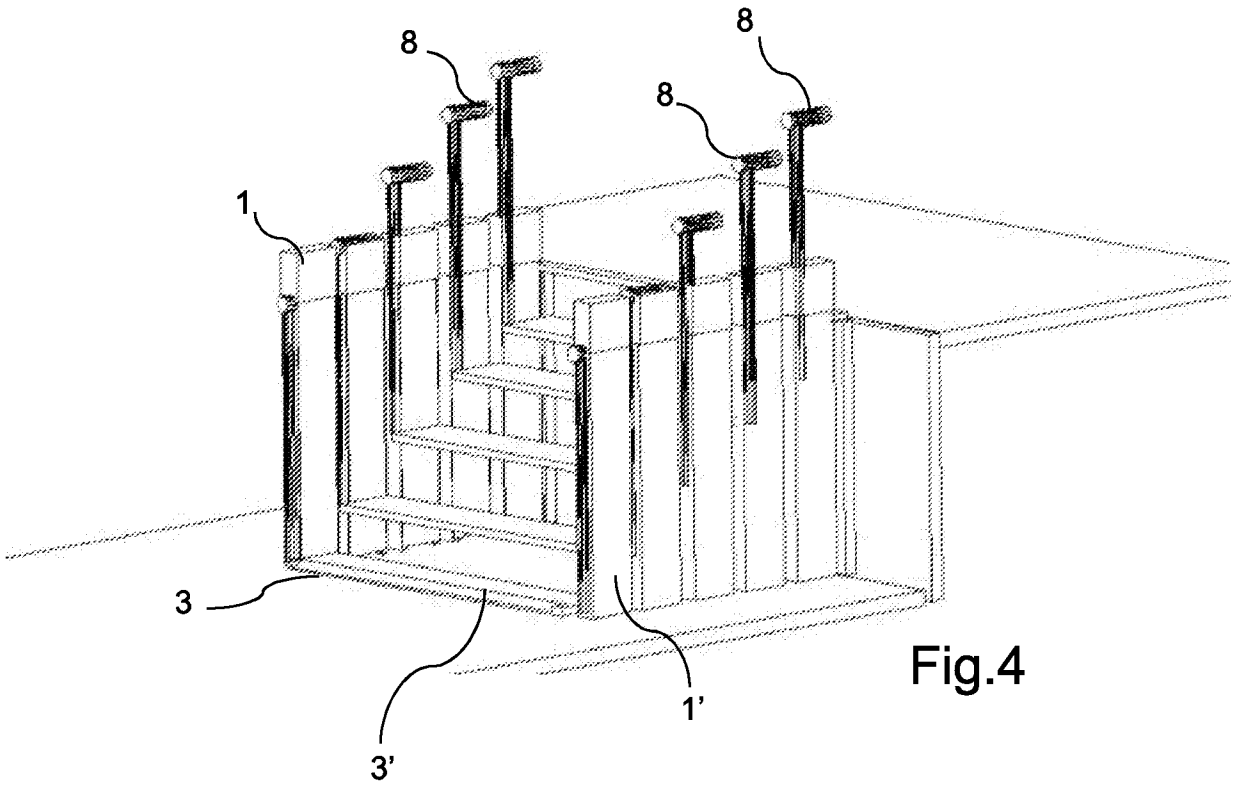
FIG. 4 shows a further variant of the group of devices in FIG. 3

FIGS. 3 and 4 instead show a further example of application of lifting devices, in a group of two or more. The group comprises means for managing the driving and overturning means of each device such as to control the latter and accordingly the overturning and lifting movement of the individual platforms in a coordinated manner; the platforms are controlled therefore to be positioned at different heights with respect to the vertical axis Y to define a flight of steps.

In such application, each lifting device may be associated with a handrail 9 of the telescopic type, such as to be adapted to the variations in position of the individual platforms. The handrail is defined by a plurality of supports attached at the free end of each platform.

FIG. 4 shows a further variant in which two devices are coupled frontally. Here, each step is obtained by overlapping the platforms of the two opposite devices in a particularly sturdy configuration.

The group described above may also have the use of a rehabilitation system with the lifting platforms arranged in a step-like configuration at different heights.

Again, in an alternative solution, gripping elements 8 such as handles or safety grips protruding from the upper face 12 may be provided on each frame 2. Each gripping element may be possibly associated with the endless screw or generally with the lifting system of the platform so that it in turn may be moved to accompany the translation movement of the platform.

The device according to the invention, and in general the aid system, provide several advantages.

Firstly, the device allows installation on any staircase or in association with any type of drop. For example, in the case of existing staircases, the device may be customized to the shape of the platform or surface finishing of it in order to be adapted to the staircase and limit the effect on its appearance. Moreover, due to the overturning movement of the platform, when the device is not in use, the staircase is completely free, with no obstacles, and this further contributes to the reduction of the effect on its appearance. Again, the device may be suitable for any type of existing staircase, even a spiral staircase, or small staircases.

A further advantage is that the device does not require architectural or structural work on the staircase in order to be installed. Indeed, it does not require foundations, specific excavations or other.

With regards to the electronic control board, this may be programmed with specific settings to meet the lifting needs defined by the drop in itself but even by the individual user. On this subject, by associating the electronic control board with a recognition system such as a badge or code, the device identifies the user and may operate according to specific user requirements or needs.

The device may also be associated with information or danger reporting systems, such as sound and/or light signals or again alphanumeric interfaces.

The use of a plurality of devices operating with one another in a coordinated manner allows great versatility of use; for example, as mentioned above, the group of devices may be used in a coordinated manner to obtain a rehabilitation device or an aid system for facilitating the descent of people with motor difficulties into water in swimming pools used for physiotherapy.

Again, the aid system that comprises a plurality of devices as mentioned above may also be possibly used as a staircase to replace a fixed architectural staircase. This obviously results in a great advantage in terms of savings and convenience of use. Moreover, when it is not in use, the aid system in fact looks like a traditional staircase, with a reduced visual impact.

The present invention was described with reference to a preferred embodiment thereof. It is intended that other embodiments may exist which relate to the same inventive core, all falling within the scope of protection of the claims indicated below.

The invention claimed is:

1. A mobility aid system for overcoming a level difference as a flight of stairs that extends between a landing (A) and a floor (Z) that is raised with respect to the landing by a vertical drop (H) assessed on a vertical axis (Y), the flight of stairs comprising a plurality of steps (S) each defining a treading surface (C) arranged horizontally and spaced vertically with respect to the preceding one by a drop (h), the system comprising a plurality of lifting devices each comprising a frame, a lifting platform being attached to the frame pivotally with respect to a horizontal direction (X) perpendicular to the vertical axis (Y), said platform being movable between a resting position arranged in a substantially vertical arrangement according to said axis (Y) to a working position arranged in substantially horizontal arrangement according to the direction (X), in said working position said platform also being movable along said frame according to said vertical axis (Y), said system comprising a lifting device arranged on the landing (A) of the flight of stairs and one lifting device for each step (S); the aid system further comprises an elevator base that can be translated along said vertical axis (Y) between the landing (A) and the raised floor (Z), wherein the elevator base is defined by one or more of the lifting platforms actuated in combination in translation along the respective frames.

2. The system according to the claim 1, wherein said elevator base when arranged at a level of the landing is defined by said platform of said lifting device arranged on the landing (A).

3. The system according to claim 1 wherein said elevator base when arranged at a level of one of said steps is defined by the lifting platform of said lifting device arranged on said step and by the platform of the lifting device arranged on the immediately preceding step.

4. The system according to claim 1 further comprising means for managing said plurality of devices in order to control the movement of each of said individual platforms in a coordinated manner.

5. The system according to claim 1 wherein each platform has sizes at least equal to the ones of the treading surface of the relative step.

6. The system according to claim 1 wherein two or more lifting devices are positioned side-by-side on the landing (A).

7. The system according to claim 1 wherein on said landing (A) is arranged a single lifting device with a platform with larger sizes than the ones of the individual step.

8. Method for the ascending of a user of a level difference as a flight of stairs implemented by the system according to claim 1 comprising the steps of:

moving said platforms of each device of said plurality from said resting position to said working position;

moving the user on the elevator base defined by said platforms of said two or more lifting devices associated with said landing (A);

lifting said elevator base until the level of the first step (S');

moving the user on the resulting elevator platform defined by the platforms of said two or more lifting devices associated with said landing and the platform of said lifting device associated with said first step;

optionally, in the case of said resulting elevator base being larger than the dimensions needed to contain the user, lowering one or more of said platforms or said devices associated with said landing (A) starting from the farthest from said first step (S');

raising said resulting elevator base until the level of the second step (S") is reached;

moving the user on the resulting elevator base defined by said preceding resulting elevator base and the lifting platform of said lifting device associated with said second step;

optionally, in the case of said resulting elevator base of said second step being larger than the ones required for the containment of the user, lowering one or more of the platforms of the preceding steps;

repeating the previous steps until reaching said raised floor (Z); and moving said user to said raised floor.

9. Method for the ascending of a level difference as a flight of stairs implemented by the system according to claim 1 comprising the steps of:

moving said platforms of each device of said plurality from said resting position to said working position;

moving the user on the elevator base defined by said platforms of said two or more lifting devices associated with said landing (A);

lifting said elevator base until the level of the first step (S');

moving the user on the resulting elevator platform defined by the platforms of said two or more lifting devices associated with said landing and the platform of said lifting device associated with said first step;

optionally, in the case of said resulting elevator base being larger than the dimensions needed to contain the user, stopping the lifting of said platforms or said devices associated with said landing (A);

raising said resulting elevator base until the level of the second step (S") is reached;

moving the user on the resulting elevator base defined by said preceding resulting elevator base and the lifting platform of said lifting device associated with said second step;

optionally, in the case of said resulting elevator base of said second step being larger than the ones required for the containment of the user, stopping the lifting of the platforms of the preceding steps;

repeating the previous steps until reaching said raised floor (Z);

moving said user to said raised floor; and lowering said plurality of lifting platforms and moving to the resting position.

10. Method for the ascending of a level difference as a flight of stairs implemented by the system according to the claim 7 comprising the steps of:

moving said platforms of each device of said plurality from said resting position to said working position;

moving the user on the elevator base defined by the lifting platform of larger sizes associated to the landing (A);

lifting said elevator base until the level of the first step (S');

moving the user on the resulting elevator platform defined by the larger platform of said lifting device associated with said landing and the platform of said lifting device associated with said first step;

raising said resulting elevator base (until the level of the second step (S") is reached;

in the case of the surface defined by the lifting platform of the first step and the lifting platform of the second step has size equal or greater than the surface of said lifting platform associated to said landing, lowering said lifting platform until the reaching of said landing, otherwise lifting said resulting elevator base defined by the lifting platforms associated to said landing and to said first and second steps;

in the case of the surface defined by the lifting platforms of the first, second and third steps has size equal or greater than the surface of said lifting platform associated to said landing, lowering the latter until the reaching of said landing, otherwise lifting said resulting elevator base defined by the lifting platforms associated to said landing and to said first, second and third steps until the fourth step;

repeating the previous steps until reaching said raised floor (Z);

moving said user to said raised floor (Z); and lowering said plurality of lifting platforms and move to the resting position.

11. Method for the ascending of a level difference as a flight of stairs implemented by the system according to the claim 7 comprising the steps of:

moving said platforms of each device of said plurality from said resting position to said working position;

moving the user on the elevator base defined by the lifting platform of larger sizes with respect to the large of the single step associated to the landing (A);

lifting said elevator base until the level of the first step (S');

moving the user on the resulting elevator platform defined by the larger platform of said lifting device associated with said landing and the platform of said lifting device associated with said first step;

raising said resulting elevator base until the level of the second step (S") is reached;

in the case of the surface defined by the lifting platform of the first step and the lifting platform of the second step has size equal or greater than the surface of said lifting platform associated to said landing, stopping the lifting of the latter, otherwise lift said resulting elevator base defined by the lifting platforms associated to said landing and to said first and second steps;

in the case of the surface defined by the lifting platforms of the first, second and third steps has size equal or greater than the surface of said lifting platform associated to said landing, stopping the lifting of said lifting platform, otherwise lift said resulting elevator base defined by the lifting platforms associated to said landing and to said first, second and third steps until the fourth step;

repeating the previous steps until reaching said raised floor (Z);

moving said user to said raised floor (Z); and lowering said plurality of lifting platforms and move to the resting position.

12. Method for the descending of a level difference as a flight of stairs implemented by the system according to claim 1 comprising the steps of:

moving said platforms of each device of said plurality from said resting position to said working position;

raising until said raised floor (Z) a congruous number of platforms belonging to steps immediately below the raised floor in order to define an elevator base adapted for the containment of an user;

moving the user on the obtained elevator base;

lowering the elevator base until the level of the lower step;

raising the first free lifting platform until the level of the elevator base;

moving the user on the elevator base obtained with the preceding elevator base and the first free lifting platform;

lowering the elevator base as obtained until the level of the subsequent step; and repeating the previous steps until reaching said landing (A).

13. Method for the descending of a level lever difference as a flight of stairs implemented by the system according to claim 1 comprising the steps of:

moving said platforms of each device of said plurality from said resting position to said working position;

raising until the raised floor (Z) a congruous number of platforms belonging to steps immediately below the raised floor in order to define an elevator base adapted for the containment of an user;

raising the first free lifting platform downstream said elevator base to a level correspondent to a vertical distance h from said elevator base, said distance h corresponding to the a height of the single step:

lifting the other lifting platform in order to define a flight of stairs, each platform being spaced from the preceding of a h vertical distance;

moving the user on the elevator base;

lowering the elevator base until the level of the first free lifting platform;

lowering the elevator base as obtained with the first free lifting platform until the level of the subsequent step;

repeating the previous steps until reaching said landing (A); and moving said plurality of lifting platforms to the resting position.

14. A group of two or more lifting devices each of which comprising a frame, a platform being attached to the frame pivotally with respect to a horizontal direction (X) perpendicular to the vertical axis (Y), said platform being movable between a resting position arranged in a substantially vertical arrangement according to said axis (Y) to a working position arranged in substantially horizontal arrangement according to the direction (X), in said working position said platform also being movable along said frame according to said vertical axis (Y), said lifting device further comprising driving means to move the platform vertically and platform overturning means to bring the platform from the resting position to the working position, said group comprising means for managing said driving and overturning means of said two or more lifting devices to move said platforms of said two or more lifting devices in a coordinate manner in order to arrange said platforms at different levels with respect to said vertical axis (Y) to define a flight of stairs, wherein each frame defines at least a lower face perpendicular to said vertical axis (Y) and two main faces of which a front face and the other rear face, that are mutually opposite and parallel and arranged along the axis (Y), the attachment between said platform and said frame being performed on such lower face or on the rear face, wherein said platform in said resting position is leant against said front face.

15. The group according to claim 14 wherein each platform provides at a its free end a handling support, a handrail being defined by said plurality of handling supports when said platforms are in the working position.

16. The group according to claim 15 wherein each lifting device comprises electronic control means, for managing and controlling said driving means and overturning means.

17. The group according to claim 16, wherein the electronic control means includes a programmable management board.

* * * * *